United States Patent [19]

Iten

[11] Patent Number: 4,789,080

[45] Date of Patent: Dec. 6, 1988

[54] UTILITY BLADE DISPENSER

[75] Inventor: Clemens A. Iten, Staunton, Va.

[73] Assignee: American Safety Razor Company, Verona, Va.

[21] Appl. No.: 854,869

[22] Filed: Apr. 23, 1986

[51] Int. Cl.[4] ..... B65D 83/10

[52] U.S. Cl. ..... 221/279

[58] Field of Search ..... 221/232, 279, 280

[56] References Cited

U.S. PATENT DOCUMENTS 1,171,478 2/1916 Tintera ..... 221/232 X 3,542,245 11/1970 Braginetz ..... 221/232

4,379,514 4/1983 Joffe ..... 221/279

*Primary Examiner*—F. J. Bartuska

*Attorney, Agent, or Firm*—Nixon & Vanderhye

[57] ABSTRACT

A utility blade dispenser having an open channel conforming to the configuration of the cutting portion of a utility blade. The channel base is defined by an upward supporting surface, and its top by a blade follower which is engaged in a pawl and ratchet fashion with tracks on the sides of a slot at the rear of the channel. The dispenser body can be molded in a two-piece mold to form an exceptionally strong blade dispenser package.

12 Claims, 4 Drawing Sheets

UTILITY BLADE DISPENSER

BACKGROUND OF THE INVENTION

Utility knives typically use disposable trapezoidal blades. These blades are very sharp, and must be handled very carefully to avoid serious injury. They are therefore typically sold in packages which also serve as dispensers permitting the extraction of one blade at a time with a minimum amount of manipulation. These dispensers must be capable of securely retaining the blades, not only when the dispenser is full for shipment to the retailer or consumer, but also as blades are extracted. It is also, of course, desirable that these dispensers be relatively simple and inexpensive to manufacture.

SUMMARY OF THE INVENTION

The present invention resides in a utility blade dispenser which is very easy to manufacture and which retains and dispenses the blades very securely and safely. These advantages are achieved through provision of a utility blade dispenser including a dispenser body having a base, means on the dispenser body for laterally supporting or containing a stack i.e., maintaining the blades in stacked condition of utility blades by contacting no more than three edges of the blades, means on the dispenser body for upwardly supporting the stack, and means engaged with a back wall of the dispenser body for downwardly retaining the stack, the upward supporting means being dimensioned to permit application of a sideways force to a utility blade at the bottom of the stack and the lateral supporting means being dimensioned to permit the utility blade to leave the stack upon application of the pushing force.

The body of the utility blade dispenser according to the present invention can be manufactured in one step using a two-piece mold. The blades can then be inserted into the dispenser, and the means for downwardly retaining the stack put in place.

BRIEF DESCRIPTION OF THE DRAWINGS

These and other advantages and features of the invention will become clearer from the following drawings, in which.

DETAILED DESCRIPTION OF THE PREFERRED EMBODIMENTS

Figure 1:
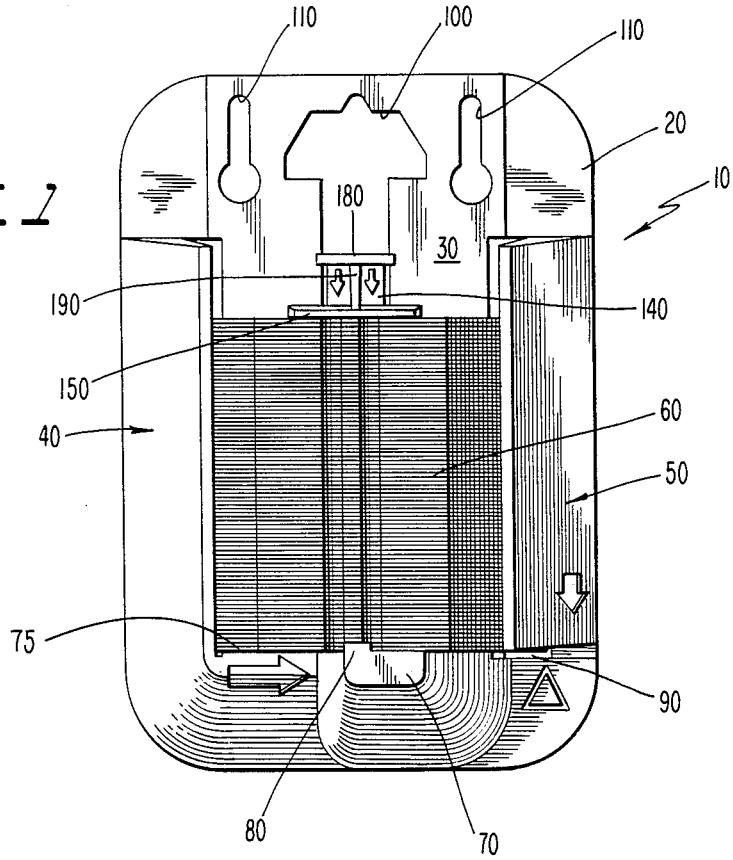
FIG. 1 is a front elevation of a utility blade dispenser according to the present invention.

Numeral 10 in FIG. 1 indicates generally a dispenser body having a base 20. Base 20 has a front surface 30 disposed centrally thereon.

Figure 2:
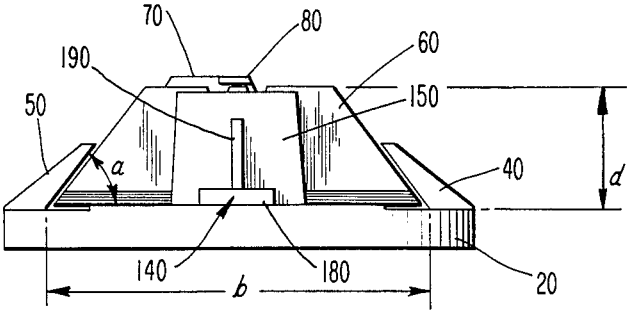
FIG. 2 is a top elevation of a utility blade dispenser of FIG. 1.

Bracketing front surface 30 are lateral supporting means in the form of first lateral wing 40 and second lateral wing 50. As can be seen best in FIG. 2, these wings project out from base 20 and toward each other to define with front surface 30 a trapezoidal channel. This trapezoidal channel is dimensioned to retain standard-sized trapezoidal utility blades 60. Thus, as is shown in FIG. 2, the first lateral wing 40 and second lateral 50 respectively form an angle with front surface 30 which is substantially equal to the base angle "a" of trapezoidal utility blade 60 (about 51° for a standard blade). Also, the based of first lateral wing 40 and the base of second lateral wing 50 are separated by a distance "b" substantially equal to the base (cutting edge) length of standard trapezoidal utility blade 60 (about 2.4 inches). First and second lateral wings 40 and 50, however, do not project out completely along the side edges of the blade 60, but instead project out only far enough to form a secure channel. In other words, first and second lateral wings 40 and 50 project away from front surface 30 by a distance less than the width "d" (measured between parallel edges) of utility blade 60 (about 0.75 inches). As will be appreciated by one having ordinary skill in the art, this feature permits the dispenser body 10 (preferably made of rigid plastic) to be molded in a two-piece mold.

Figure 3:
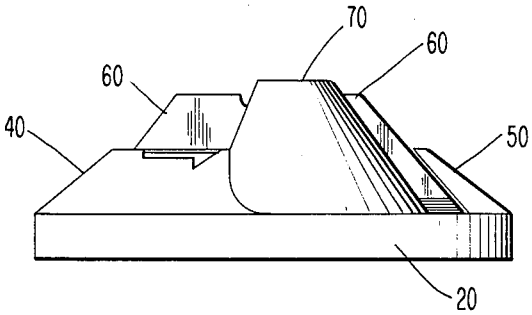
FIG. 3 is a bottom view of the dispenser of FIG. 1.

At the bottom of dispenser body 10, disposed beneath front surface 30, is a projection 70 (FIG. 3) which together with an adjoining ledge 75 serves as means for upwardly supporting the stack of razor blades 60. This projection 70 projects outward from surface 30 by a distance greater than utility blade width "d" so that a lip 80 formed on projection 70 juts upward in front of a razor blade on the bottom of the stack. The edge 75 is configured to expose part of the lower surface and side edge of the bottom utility blade 60 so that a sideways pushing force may be applied at those spots. It is also dimensioned to define, in cooperation with second lateral wing 50, an exit aperture 90 through which the bottom utility blade 60 can exit upon application of the sideways pushing force. Lip 80 is provided on projection 70 to supply an additional retaining force because the side of the lowermost utility blade 60 adjacent exit aperture 90 is not retained by second lateral wing 50.

Figure 4:
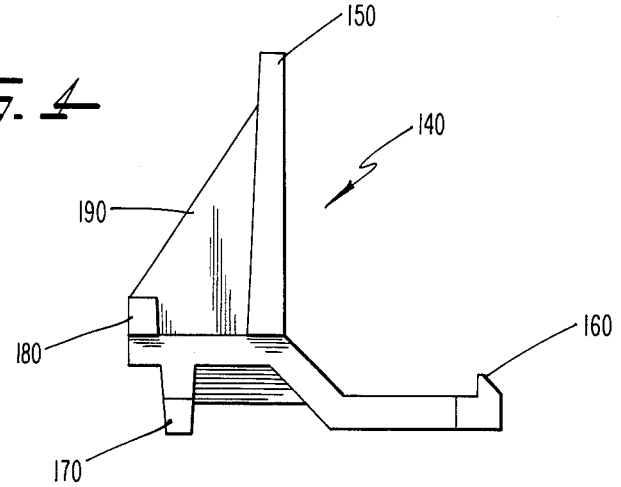
FIG. 4 is a side view of the downward blade retaining means shown in FIGS. 1–3.

Centrally disposed in front surface 30 is a vertical slot 100. This slot has an enlargement at its uppermost portion and an elongated lower portion which is substantially rectangular. The enlargement is configured to facilitate insertion into vertical slot 100 of means for downwardly retaining the stack of utility blades which, in the presently preferred embodiment, takes the form of blade follower 140. As can be seen in FIG. 4, blade follower 140 has a blade engaging surface 150, a pawl projection 160 and first and second follower projections 170 and 180 which define between them a channel for receiving the sides of vertical slot 100. A matching set of projections on the opposite side of follower 140 define a matching channel there. The follower also includes a reinforcing web 190.

As can be seen in FIGS. 1 and 2, after utility blades 60 have been introduced into the channel formed by front surface 30 and first and second lateral wings 40 and 50, the follower is inserted in the enlargement in vertical slot 100 and moved downwardly until blade engaging surface 150 contacts the upper surface of uppermost utility blade 60. The channels formed on either side of follower 140 engage the sides of the rectangular portion of vertical slot 100. The blade follower is thus retained in the slot.

Figure 5:
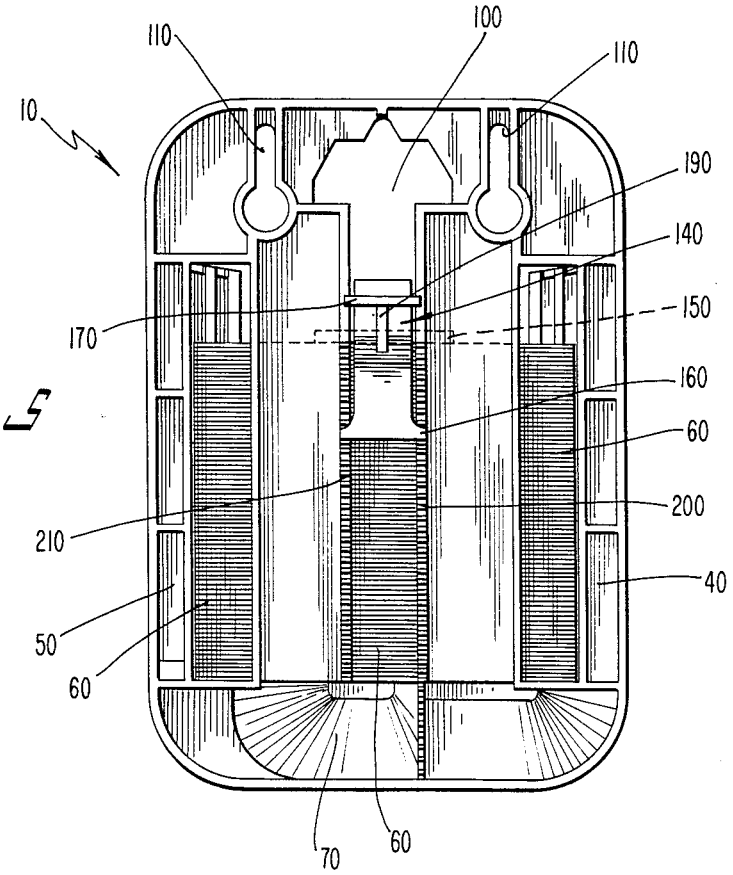
FIG. 5 is a rear view of the utility blade dispenser shown in FIGS. 1–3.

FIG. 5 shows the back of a dipsenser body 10. As can be seen therein, the dispenser body is preferably molded of plastic, with a reinforcing webbing provided on the undersides of the lateral wings, and around the hangholes 110. Projection 70 is substantially hollow. The sides of the rectangular portion of vertical slot 100 are provided with first and second ratchet tracks 200 and 210. In a manner which will be apparent to one of ordinary skill in the art, when the blade follower 140 is inserted in channel 100 in the manner described above, the pawl projection 160 will engage both first ratchet track 200 and second ratchet track 210. This permits blade follower 140 to be brought downward into engagement with the uppermost utility blade 60, but prevents blade follower 140 from moving back upward, even under the weight of the stack of blades. It will be noted that second ratchet track 210 is shorter than ratchet track 200 in that it does not extend downward past the vertical position of projection 70. It is possible to design the ratchet tracks in this fashion because when the follower 140 has moved down so that the follower pawl 160 is in a position near the end of second ratchet track 210, there are so few blades in the stack that one track is sufficient to retain the follower in its vertical position.

The blade dispenser is preferably made large enough to store an appropriate number of razor blades, for example, one hundred. A typical utility blade is approximately 0.025 inches thick. Thus, the length of the open trapezoid channel defined by front surface 30 and first and second lateral side wings 40 and 50 would preferably be somewhat greater than 2.5 inches, say 2.7 inches, if it is desired that the channel be able initially to hold one hundred such blades. The overall length of the dispenser will include this length as well as the length of the bottom section including projection 70 (about 0.7 inches the presently preferred embodiment) and the upper section including the widened portion of vertical slot 100 (about 1.2 inches in the presently preferred embodiment). The lateral side wings are each 0.682 inches deep to project about 0.420 inches away from front surface 30. The overall width of the presently preferred embodiment is approximately 3.10 inches.

As shown in the drawings, the edges of the presently preferred embodiment are contoured. The edges of the base are rounded, and the first lateral wing 40 joins smoothly with ledge 75. These features give the dispenser a sleeker, more finished look.

As will be appreciated from the foregoing, the present invention provides a utility blade dispenser which is extremely simple and economical to manufacture. The dispenser body 10 can be manufactured in a two-piece mold out of plastic material. The lateral wings and projection are all formed integrally with the dispenser body base. The follower can also be manufactured in a two-piece mold. The dispenser provides the benefit that the blades are clearly visible to enable ready determination of how many blades are left. When the user wishes to extract the blade, it is necessary only to apply pushing force to the lowermost blade 60 through the aperture formed by the shape of the projection 70. The blade then can leave the stack through the exit aperture underneath the second lateral wing 50. The lip 80 prevents utility blade 60 from rotating.

It will be apparent to one of ordinary skill in the art that many modifications can be made to the particular embodiment which has been specifically described above without departing from the essential teachings of the invention. Therefore, the particular embodiment described above should be regarded as exemplary only, and as only one of many possible configurations of the invention.

What is claimed is:

1. In combination with a stack of utility blades each having a generally trapezoidal shape with four discrete sides including a base edge and an outer edge shorter than said base edge lying parallel to said base edge, with the remaining two sides inclined from said base edge and interconnecting the parallel edges at opposite ends of the blade, a dispenser comprising:

a dispenser body having a base;

means on said dispenser body for laterally constraining said stack of said utility blades in contact with said dispenser body by contact with no more than three edges of said blades including, for all blades in the stack above the lowermost blade, contact between said base and side edges of the trapezoidally shaped blades and without contact with the short edges of the blades, said lateral constraining means comprising first and second lateral wings integral with and projecting forwardly at equal acute angles from said dispenser body base, the portions of said dispenser body in contact with said side and base edges constituting said wings and said dispenser base, respectively, for all blades in the stack above the lowermost blade, said wings having vertically extending outermost edges spaced laterally one from the other throughout their vertical extent a distance greater than the length of said short edges such that the dispenser is open along a front face thereof completely laterally exposing the short edges of the stack of blades above the lowermost blade in the stack;

means on said dispenser body engageable with the lowermost blade of the stack for supporting said stack on said dispenser body, said means being dimensioned to permit application of a pushing force to the lowermost blade at the bottom of said stack; and means movably engaged with said dispenser body base for engaging the uppermost blade in the stack and maintaining the blades in stacked condition;

said lateral constraining means being dimensioned to permit the lowermost blade of the stack of utility blades to leave the stack thereof in a lateral direction upon application of the pushing force.

2. A dispenser as claimed in claim 1 wherein said dispenser is molded of plastic.

3. A dispenser as claimed in claim 1 wherein said dispenser body base has a vertical slot, and wherein said maintaining means comprises a blade follower engaged with sides of said slot.

4. A dispenser as claimed in claim 3 wherein said vertical slot has two parallel vertical sides provided respectively on a back surface of said base with a first and second ratchet track, and wherein said follower includes a pawl projection projecting through said slot for engagement with both said first and second ratchet tracks along the back surface of said base.

5. A dispenser as claimed in claim 4 wherein at least one of said first and second ratchet tracks extends downward past a lowermost portion of said vertical slot and downwardly past the lowermost end of the other of said ratchet tracks.

6. In combination with a stack of utility blades each having a generally trapezoidal shape with four discrete sides including a base edge of predetermined length and an outer edge shorter than and parallel to said base edge, with the remaining two sides inclined from said base edge at base angles of like magnitude interconnecting the parallel edges, the perpendicular distance between said parallel edges defining a blade depth, a dispenser comprising:

a dispenser body having a front surface at least partially forming a rear wall of a channel for retaining said utility blades;

first and second vertical side wings on said dispenser body, bracketing said front surface and spaced on said dispenser body a distance substantially equal to said base edge length, said first and second vertical side wings projecting outward from said dispenser body a distance less than said depth and toward each other at an angle with said dispenser body substantially equal in magnitude to said base angle, said first and second vertical side wings at least partially forming angled sides of said channel;

a blade support projecting forward from a bottom portion of said dispenser body and at least partially forming a bottom of said channel, said blade support having a first portion projecting forward a distance less than said depth to form an access aperture permitting application of a sideways force to a utility blade atop said blade support;

a blade follower received in a vertical slot in said front surface between said first and second wings and at least partially forming a movable top of said channel;

a top surface of said blade support being lower than the lower edge of said second wing by a distance greater than said blade thickness to form an exit aperture through which said utility blade atop said blade support may leave said channel through said access aperture upon said application of said sideways force, said channel formed by said front surface and said wings being open along a side thereof opposite said front surface and for substantially the entire vertical extent of said wings such that said stack of blades above the lowermost blade in said dispenser are laterally constrained by contact with no more than three edges of said blades and the dispenser is open along a front face thereof with the short edges of the blades otherwise laterally unrestrained by said dispenser body;

said vertical slot having two parallel vertical sides provided respectively at a back surface of said dispenser body with a first and second ratchet track, and wherein said follower includes a pawl projection for projecting through said slot for engagement with said first and second ratchet tracks along the back surface of said base.

7. A dispenser as claimed in claim 6 wherein at least one of said first and second ratchet tracks extends downward on said back surface past a lowermost portion of said vertical slot and downwardly past a lowermost end of the other of said ratchet tracks.

8. A dispenser as claimed in claim 6 wherein said dispenser body, first and second vertical side wings, and blade support are integral and formed of rigid plastic.

9. A dispenser according to claim 6 wherein said three contacting edges of said lowermost blade constitute said base edge, one side edge, and said shorter edge.

10. A dispenser according to claim 6 wherein said lateral constraining means includes a lip carried by said supporting means for engaging the short edge of the lowermost blade in the stack, the portions of said dispenser body in contact with the three edges of the lowermost blade of the stack to provide lateral constraint therefor constituting said base, one of said side wings and said lip.

11. For utility blades in the form of a regular trapezoid and having a predetermined thickness, depth, base angle, and base length, a dispenser comprising:

a dispenser body having a front surface at least partially forming a rear wall of a channel for retaining said utility blades;

first and second vertical side wings on said dispenser body, bracketing said front surface and spaced on said dispenser body by a distance substantially equal to said base length, said first and second vertical side wings projecting outward from said dispenser body by a distance less than said depth and toward each other at an angle with said dispenser body substantially equal to said base angle, said first and second vertical side wings at least partially forming angled sides of said channel;

a blade support projecting forwardly from a bottom portion of the rear wall of said dispenser body and at least partially forming a bottom of said channel, said blade support having a first portion projecting forward by a distance less than said depth to form an access aperture permitting application of a sideways force to a utility blade atop said blade support;

said blade support including a second portion projecting forwardly of the rear wall of said dispenser body a distance beyond the distance said side wings project from said dispenser body, said second portion carrying an upwardly projecting lip for engaging the shorter edge of a blade to prevent outward movement of the blade in a direction away from and normal to said base and facilitating sideways sliding movement of the blade through said access aperture; and a blade follower received in a vertical slot in said front surface between said first and second wings and at least partially forming a movable top of said channel;

a top surface of said blade support being lower than the lower edge of said second wing by a distance greater than said blade thickness to form an exit aperture through which said utility blade atop said blade support may leave said channel through said access aperture upon said application of said sideways force.

12. A dispenser according to claim 11 in combination with a stack of utility blades disposed in said channel, each blade being in the form of a regular trapezoid having a base edge, oppositely disposed side edges inclined from said base edge toward one another and an outer edge shorter than the base edge, said depth constituting the shortest straight line distance between said base and said short edge.

* * * * *